United States Patent [19]

Höft et al.

[11] Patent Number: 4,593,834

[45] Date of Patent: Jun. 10, 1986

[54] OPENING MEANS FOR OBLONG CANS

[75] Inventors: Peter Höft, Braunschweig; Wolfgang Peter; Heinz Hacke, both of Cuxhaven; Jürgen Lühr, Ihlienworth; Johann Bergsteiner; Wolfgang Drobe, both of Bremerhaven; Fritz Engelke, Cuxhaven; Walter Hebbinghaus, Cuxhaven; Siegfried Kuhnert, Cuxhaven, all of Fed. Rep. of Germany

[73] Assignee: Schmalbach-Lubeca AG, Braunschweig, Fed. Rep. of Germany

[21] Appl. No.: 762,159

[22] Filed: Aug. 2, 1985

[30] Foreign Application Priority Data

Aug. 17, 1984 [DE] Fed. Rep. of Germany ..... 3430382

[51] Int. Cl.[4] ..... B65D 17/34

[52] U.S. Cl. ..... 220/273

[58] Field of Search ..... 220/269, 270, 271, 272, 220/273

[56] References Cited

U.S. PATENT DOCUMENTS

| | | | |
|---|---|---|---|
| 3,478,918 | 11/1969 | Zundel | 220/273 |
| 3,591,037 | 7/1971 | Schreker et al. | 220/273 |
| 3,653,536 | 4/1972 | Schrecker | 220/273 |
| 3,682,350 | 8/1972 | Baugh et al. | 220/273 |
| 3,735,892 | 5/1973 | Kinkel | 220/273 |

*Primary Examiner*—George T. Hall

*Attorney, Agent, or Firm*—Karl F. Ross; Herbert Dubno

[57] ABSTRACT

There is provided a tin lid for flat cans rounded oblong, in Hansa format, which includes in its lid image section, a tear-open portion defined by a self-contained notch line capable of being broken up at one end of the lid by means of a pull-open ring attached to this end. At the other end, said notch line includes a straight-lined notch line section which extends in chordal-type fashion with respect to the core wall shaped like an arc of a circle and which is arranged perpendicular and symmetrically to the longitudinal lid center line and which is connected with the other portions of the notch line through a polygonal or chordal-type connecting notch line. The distance between the chordal-type notch line section and the core wall, measured along the longitudinal center line of the lid, preferably ranges between 6 and 10 mm.

6 Claims, 2 Drawing Figures

OPENING MEANS FOR OBLONG CANS

Figure 1:
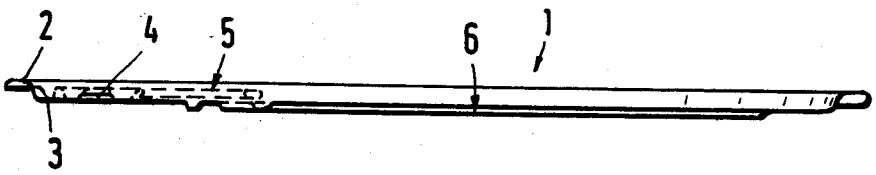

This invention relates to a tin lid for out-of-round cans, in particular, for cans rounded oblong, for instance, in Hansa format, comprising the features of the generic clause of patent claim 1. There is a large commercial market for such types of lid which are used for closing elongated cans usually of little depth and rounded at their ends like an arc of a circle. To make removal of the contents more easy, such lids are generally formed as tops capable of being fully torn off, which means, after the tear-open portion has been removed, practically the entire area of what normally constitutes the lid and is hereinafter referred to as "lid image section" is substantially exposed. However, there are certain limitations that have to be put up with for reasons regarding manufacture as well as for reasons of safe and easy opening of the tear-open portion.

Since the cans as well as the lids of the aforementioned type are nowadays made of thin plate material, the lid tear-open portion is relatively labile and its capacity of storing spring forces consequently is increased and therefore, the consumer frequently has difficulties in opening such a can without the contents being splashed.

A can of the aforementioned type which has been on the market for years, includes various and differently oriented groups of bead at the end of the lid tear-open portion accommodating the pull-open ring as well as at the opposite end thereof to facilitate can opening and to reduce the indicated problems, the beads provided in the area of the pull-open ring being arranged substantially perpendicular to the longitudinal can center line and being either formed in a straight line or being slightly bent, whereas in the end section of the tear-open portion, a plurality of beads are either oriented parallel to the longitudinal center line or define an acute angle with respect to the tear-open direction. Rolling up of the plate at the tear-open end of the tear-open portion is to be thereby facilitated, while in the end section of the tear-open portion an approximately board-like, stiff type of construction is intended to be achieved by means of the beads. The present invention particularly relates to lids having various deformations or beads provided in the pull-open ring area and in the end section.

Long experiences gained in the field of lids of the known type show that the plates and plate thicknesses conventionally employed still render it impossible to exclude the drawback that in the last phase of separating the tear-open portion from the lid, the torn off lid portion (tear-open portion) undergoes uncontrolled spring movement, is thus dipped into the can and causes sauce to splash. Even sauce particles only covering the lid portion may be caused to splash owing to the spring action.

This not only applies to cans of the Hansa shape in which, as mentioned hereinbefore, the end sections of the can are curved in semicircular fashion to obtain a substantially oval shape, but it also applies to other cans out-of-round.

In case of the known cans of this type, the extension of the notch line differs from the configuration of the can only in the area where the pull-open ring is fixed, whereas otherwise, the notch line is slightly spaced from the lid core wall and extends parallel thereto at all points, a fact that also applies to the lid end remote from the pull-open ring.

It is an object of the present invention to further develop the lid of a can including the features of the generic clause of claim 1 such that the danger of splashing or even, of being injured by the tear edge of the tear-open portion in the last phase of separating the tear-open portion from the can is even more strongly and reliably averted than hitherto possible, to so essentially facilitate can handling upon opening.

This task is solved by the features stated in patent claim 1.

Owing to the new construction, in particular, in case of a polygonal extension of the notch line sections adjacent to the straight-lined, in particular, chordal-like section, the tearing force in the last third of the tear-open area is reduced to a large extent. Consequently, bulging of the tear-open portion is kept low and the spring force stored in the plate is also reduced. This effect may be even more intensified by a specific arrangement and structure of beads or deformations in this area.

The straight-lined notch line section is formed as a hinge-like line of enormously reduced length compared to the width of the tear-open portion. The board-like end section may be pivoted about this line approximately once without any physical effort and consequently, it may be removed without any difficulties and without any tendency to spring movement. This function may be further intensified by increasing the residual wall thickness in the straight-lined notch line section, a means preventing the lid from being torn off when the can is opened. When the lid is torn off, the plate undergoes a strong spring movement. When the can is opened by tearing, this procedure will end at the end points of the straight-lined notch line sections.

It will be advantageous if the residual wall thickness in the straight-lined notch line section is about 20% to 70% greater than the thickness in the remaining sections.

The length of the chordal-type notch line section is to take up a considerable part of the maximum width of the tear-open portion. Preferably, the length of the chordal-type notch line section located at right angles and symmetrically to the longitudinal lid center line is to almost equal half of the maximum width of the tear-open portion. This applies above all to lids in Hansa format.

The end points of the straight-lined notch line section may be connected with the respective end points of the straight-lined notch line sections extending along the longitudinal lid edges, via a notch line extending in an arc-shaped fashion or approximately parallel to the curvature of the lid configuration. Preferably, however, the connecting notch line is also formed in straight-lined fashion, in particular, in chordal-type fashion with respect to the extension of the core wall in the end section of the lid, the connection being materialized by one or a plurality of chordal-type notch line sections defining various angles with respect to the longitudinal center line of the lid. Thereby, any tearing-open forces are reduced and the tear-open portion is more intensively prevented from rolling up as well as from undergoing a spring movement.

The distance between the chordal-type notch line and the lid core wall, measured along the center line, is decisive for the length of the chordal-type section. The distance from the core wall, however, continues to favour splash-free separation of the tear-open portion from the lid.

Figure 2:
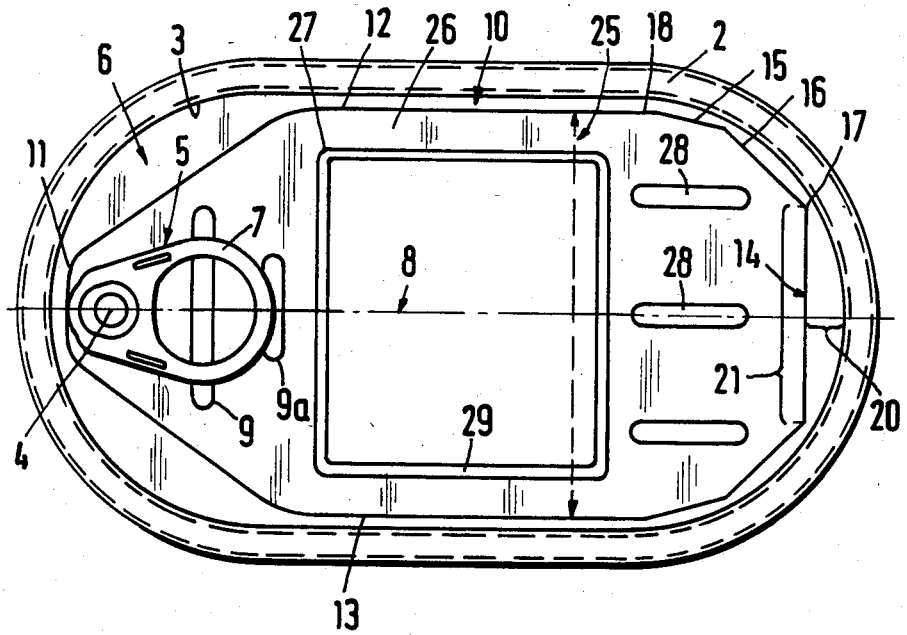

The invention will hereinafter be described in more detail on the basis of one embodiment and with reference to the accompanying drawings, wherein FIG. 1 shows a longitudinal section of a lid in Hansa format, formed according to the invention and FIG. 2 represents a top view of the lid.

In accordance with FIG. 2, lid 1 employed in a can in Hansa format is of a rounded oblong configuration which is typical of this format and includes, as usual, a steep core wall 3 adjacent to edge areas 2, which core wall changes into the lid image section 6. Said lid image section 6 is provided with a tear-open portion 26 which takes up almost the greatest part of the lid image section and which is determined by one or a plurality of notch lines 10. Notch line 10 is self-contained, extends along the longitudinal edges of the lid in slightly spaced relationship to the core wall and parallel thereto and consists, in these areas, of straight-lined notch line sections 12 and 13. At one end of the lid image section 6 determined by the extension of core wall 3 shaped like an arc of a circle, the notch line sections converge toward a starting portion 11 located near to the core wall.

In this area of the tear-open portion, there is secured—by means of a rivet 4—a lever-type pull-open ring 5 so as to be in flat contact with the lid image section, one end of said pull-open ring being disposed on top of said starting portion 11 of the notch line and the other end being formed as a pull-open end 7 extending in the direction of the longitudinal center line 8 of the lid.

In accordance with the embodiment shown, the pull-open ring area of the tear-open portion may include two or more than two beads 9 and 9*a* extending transversely to the longitudinal center line 8 and being either formed as a straight line or being slightly bent. In the remaining sections as well, the tear-open portion 26 is provided with stiffening deformations 29 and/or beads 28, which, in the embodiment shown, are arranged parallel to the longitudinal edges and parallel to each other and to the longitudinal center line 8 and are distributed over the width of the tear-open portion.

At the end of the tear-open portion 26 remote from the notch line starting portion 11, said notch line includes a straight-lined notch line section 14 extending in chordal-type fashion with respect to the extension of the core wall 3 shaped like an arc of a circle.

In the embodiment shown, this section is located perpendicular and symmetrically to the longitudinal center line 8. Measured along the longitudinal center line 8, the chordal-type notch line section 14 is spaced from the core wall 3 at a distance 20 ranging between 2 and 15 mm. Preferably, however, the distance ranges between 6 and 10 mm. Length 21 of the chordal-type notch line section between its end points 17 preferably amounts to approximately half of the maximum width 25 of the tear-open portion 26.

The end points 17 of the chordal-type notch line section 14 are connected with the associated end points 18 of the straight-lined notch line sections 12, 13 extending parallel to the longitudinal lid edge through connecting notch line sections. These connecting notch line sections may be bent or, if need be, may follow the extension of the core wall 3 shaped like an arc of a circle. However, preferably, this connecting notch line section is also straight-lined and located and formed in a chordal-type fashion with respect to the core wall shaped like an arc of a circle. Consequently, the end points 17 and 18 may be directly connected by one straight-lined notch line only. In the embodiment shown, however, the connecting notch line consists of two chordal-type sections 15 and 16, each extending in straight-line fashion and defining various angles with respect to the longitudinal center line 8.

Practice has shown that in the area of the tear-open portion, in which said core wall 3 extends like an arc of a circle in the end section of the tear-open portion 26, a polygonal extension of the notch line would be most expedient, as has been illustrated in FIG. 2. However, this does not exclude that the transition zones at the polygonal corners are respectively formed by sections of a very small radius of curvature.

Sections 15 and 16 of the connecting notch line may be equal in size or may differ.

In one embodiment, the chordal-type notch line section 14 is of a greater residual wall thickness than the remaining sections of the notch line 10. It may be 20% to 70% greater than the residual wall thickness of the normal notch line.

To support the board-like effect on the chordal-type notch line section 14 there are provided deformations and/or beads 28, 29.

We claim:

1. A tin lid for out-of-round cans, in particular, cans rounded oblong, for instance, in Hansa format, comprising a tear-open portion which takes up almost the greatest part of the lid image section defined by the lid core wall, is enclosed by a self-contained notch line including a starting portion in the area of one lid end and extending tightly along the longitudinal lid edges and parallel thereto, and which has secured thereto, in the area near to the starting portion, a lever-type pull-open ring so as to be in flat contact with said tear-open portion, the end of the pull-open ring extending in the longitudinal lid direction, wherein the tear-open portion is stiffened by means of a plurality of beads or the like, which are aligned with the longitudinal lid direction and/or with the transverse lid direction in a predetermined manner, characterized in that said tear-open portion (26) is defined by a notch line section (14) provided at the end of the lid (1) remote from the starting portion (11), the length (21) of said notch line section being considerably smaller than the maximum width (25) of the tear-open portion, approximately parallel thereto and with said notch line section being straight-lined and extending in chordal-type fashion with respect to an arc-shaped extension of the core wall (3), the distance (20) between the straight-lined notch line section (14) and the lid core wall (3)—measured along the longitudinal center line (8) of the lid—ranging between 2 and 15 mm.

2. A lid according to claim 1 characterized in that the distance (20) ranges between 6 and 10 mm when rounded oblong lids are employed.

3. A lid according to claim 1 or 2 characterized in that the length (21) of the straight-lined notch line section (14) located perpendicular and symmetrically to the longitudinal center plane (8) approximately corresponds to half of the maximum width (25) of the tear-open portion (26).

4. A lid according to claim 1 characterized in that the respective end points (17, 18) of the straight notch line sections (14, 12 and 14, 13, respectively) are interconnected by means of notch line sections extending in an arc-shaped fashion.

5. A lid according to claim 1 characterized in that the end points (17) of the straight-lined notch line section (14) are connected with the associated end points (18) of the two notch line sections (12, 13) extending in straight-lined, parallel fashion to the longitudinal lid edges, through one or a plurality of notch line sections (15, 16) respectively extending in straight line and defining various angles with respect to the longitudinal center line (8) of the lid.

6. A lid according to claim 1 characterized in that the residual wall thickness of the cordal-type notch line section (14) is approximately between 20% to 70% greater than the residual wall thickness in the remaining notch line (10) sections.

* * * * *